US005625939A

United States Patent [19]

Carey et al.

[11] Patent Number: 5,625,939

[45] Date of Patent: May 6, 1997

[54] METHOD FOR ASSEMBLING AN INDUCTIVE DEVICE

[75] Inventors: Steve M. Carey, Brandon; James H. Ball, Magee, both of Mich.; Raymond H. VanWagener, Darien, Conn.

[73] Assignee: MagneTek, Inc., Los Angeles, Calif.

[21] Appl. No.: 397,574

[22] Filed: Mar. 2, 1995

Related U.S. Application Data

[62] Division of Ser. No. 226,714, Apr. 12, 1994, Pat. No. 5,510,762.

[51] Int. Cl.[6] ..... H01F 7/06

[52] U.S. Cl. ..... 29/605; 29/854

[58] Field of Search ..... 29/605, 606, 607, 29/854, 874, 883, 602.1; 336/183, 184, 192, 107; 174/DIG. 2

[56] References Cited

U.S. PATENT DOCUMENTS

| | | | |
|---|---|---|---|
| 2,364,684 | 12/1944 | Aust | 29/607 |
| 4,249,229 | 2/1981 | Hester | 336/184 X |
| 4,581,820 | 4/1986 | Zahn et al. | 29/855 |
| 5,006,764 | 4/1991 | Swanson et al. | 174/DIG. 2 X |
| 5,224,874 | 7/1993 | Sell | 29/883 X |
| 5,257,611 | 11/1993 | Chapekis et al. | 29/606 X |
| 5,510,762 | 4/1996 | Carey et al. | 336/192 |

*Primary Examiner*—Peter Vo
*Assistant Examiner*—Khan Nguyen
*Attorney, Agent, or Firm*—Darby & Darby

[57] ABSTRACT

A method of assembling a leadless type ballast transformer having a connector at one end of the housing for accepting a mating connector which supplies voltage to the ballast and provides the operating voltage to the lamps controlled by the ballast. Uninsulated connection leads extending inwardly of the housing from the connector terminals to contact the lugs of a terminal board adjacent a transformer coil with the magnet wires of the transformer coils also being in contact with the terminal board lugs. The connection leads and magnet wires are permanently electrically connected to the terminal board lugs by ultrasonic welding.

10 Claims, 3 Drawing Sheets

METHOD FOR ASSEMBLING AN INDUCTIVE DEVICE

This is a division of application Ser. No. 08/226,714, filed Apr. 12, 1994,is now U.S. Pat. No. 5,510,762.

BACKGROUND OF THE INVENTION

Various arrangements exist for the connection of leads from inductive devices, such as a transformer, to the power source and other wiring. Typically, an inductive device comprises one or more coils of magnet wire forming primary and secondary windings, to which larger size power supply and other wiring leads are connected. This is done either directly or through the intermediate use of a terminal board. The power supply and other wiring leads which extend from the inductive device are either to be connected directly to the power supply or to other wiring circuits.

In one type of an inductive device, a ballast transformer for fluorescent lamps, a leadless arrangement is used in which a connector is located in an end wall of the ballast transformer housing. The transformer within the housing is provided at one or both ends with a terminal board having a plurality of lugs. The magnet wires of the various transformer coils, some of which wires extend across the top of the coils, are attached to the terminal board lugs by conventional soldering, i.e., heating a metallic compound to a molten state. Next, an internal socket wire harness assembly is made by stripping the ends of insulated wires. One of the ends of each of these wires is soldered to a terminal board lug and the other end to a terminal of the connector in the housing end wall. Accessory components, such as capacitors, resistors, etc., may also be soldered to the terminal board lugs. The connector has a number of pins to which connection is made to other circuits or wires by a socket which is plugged into the connector from outside the housing.

During assembly of this type of device, the insulated wire leads used within the housing must be stripped. Also, connection of the lead wires to the terminal board lugs and the connector terminals and the connection of other components such as capacitors and thermal cut-outs requires a substantial amount of connecting operations, such as twisting and crimping and soldering of individual connections. The assembly is time consuming. Also, the presence of various lead wires and magnet wires results in an arrangement of wires which is somewhat dispersed and often raises difficulty in lead and component dressing. In general, the entire process including the soldering is time consuming, requires considerable manual labor and also has environmental problems in the production of fumes during the soldering operation.

BRIEF DESCRIPTION OF THE INVENTION

The present invention relates to a method and apparatus for providing external connection to an inductive device, such as a leadless ballast including a transformer, having a connector at the ballast housing end wall, i.e., no leads extend from the ballast housing. In accordance with the invention, an inductive device within a housing has a terminal board with a plurality of spaced lugs. A connector mounted on a housing wall has a plurality of wire connection leads extending from its terminals toward a terminal board mounted on the transformer. The ends of the extending connection wire are placed directly into engagement with the terminal board lugs. The ends of the magnet wires of the inductive device coils are wrapped over certain of the terminal board lugs. Also, leads of additional components, such as capacitors, resistors and thermal cut-outs, are directly attached to the extending connection wires.

The final, fixed connection of the various connection leads and the ends of the magnet coil wires to the terminal board lugs is accomplished by the use of ultrasonic welding in a gang type arrangement. That is, all of the final terminal board connections and magnet wire connections can be made at the same time. This reduces the assembly time. Also, since there is no soldering the production of fumes is eliminated.

OBJECTS OF THE INVENTION

It is an object of the present invention to provide a novel method and apparatus for effecting connections between an inductive device and a power source.

A further object is to provide a leadless type transformer having a connector at an end of its housing with the connector terminals carrying uninsulated pins.

It is another object to provide a method of assembling a leadless type inductive device in which connection leads extending from terminals of a connector engage and are ultrasonically welded to lugs of a terminal board of the device to which magnet wires are ultrasonically welded with all of the magnet wires being fixedly welded in a gang type ultrasonic welding operation.

An additional object is to provide a method of producing a leadless type inductive device in which all of the connections between a terminal board and magnet wires of the device and leads to a connector as well as leads of auxiliary components are made at the same time.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
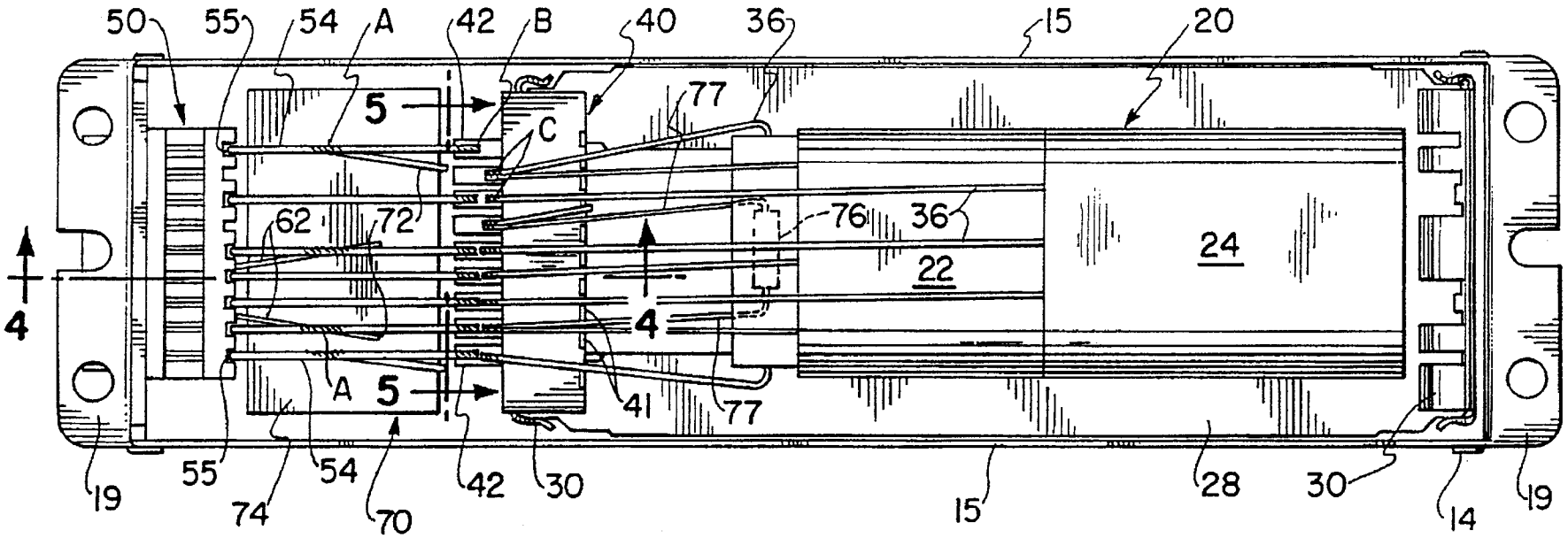
FIG. 1 is a top plan view of a ballast transformer made in accordance with the invention.

Referring to the drawings, an inductive device 10 is shown which is, illustratively, a fluorescent lamp-type ballast transformer. The device includes a housing 14 of any suitable material, such as metal or plastic, with sidewalls 15 and end walls 17. Mounting lips 19 extend from each of the end walls 17, having suitable slots and holes used for mounting the housing to ceiling walls, studs, fixture, etc.

Within the housing 14 is a transformer 20, illustratively shown as having a primary winding 22 and a secondary winding coil 24 mounted on a stack of laminations 28. A clamp 30 is provided at each end of the lamination stack 28 to hold the laminations together. The number and type of windings and the shape and size of the laminations are selected in accordance with the requirements of the transformer 20 and are not critical with respect to the. invention.

The windings 22 and 24 are formed of one or more coils of magnet wire of suitable diameter corresponding to the voltage, transformer ratio to be obtained, etc. A number of the ends 36 of these magnet wires are illustratively shown. These magnet wires must be selectively connected to each other, to the power source and to other components, e.g., capacitors, thermal cut-outs, etc.

A terminal board 40 is mounted to one of the clamps 30 of the transformer 20 such, for example, by riveting, an adhesive, snap on, fasteners, lugs and slots, etc. The terminal board 40 is conventional and of a suitable insulating material. A number of lugs 42 of electrically conductive material extend from one side of the board. The lugs 42 are generally flat, extend horizontally and are evenly spaced with respect to each other. On the other side of terminal board 40 is a frame of a suitable material, such as plastic or nylon, having a plurality of alignment tabs 41.

A connector 50 of a suitable insulating material is mounted to one of the housing end walls 17 by any suitable fastening arrangement, e.g., rivets, screws, press-fits, etc. The connector 50 has a plurality of terminals with ends 52 which extend into the housing 15. The terminal ends 52 preferably have the same spacing as the terminal board lugs 42 and are in line with each other. The connector's terminal ends extending outward of the housing are pins or jacks 53 which accept corresponding jacks and pins of an external connector plug or socket (not shown). The external connector plug or socket has wires used to connect the transformer to the power supply or to other circuits.

A capacitor box 70 is mounted to the housing bottom wall 14. Box 70 has a capacitor of a value corresponding to the operation of the ballast. The box 70 has a plurality of extending terminals 72.

Figure 2:
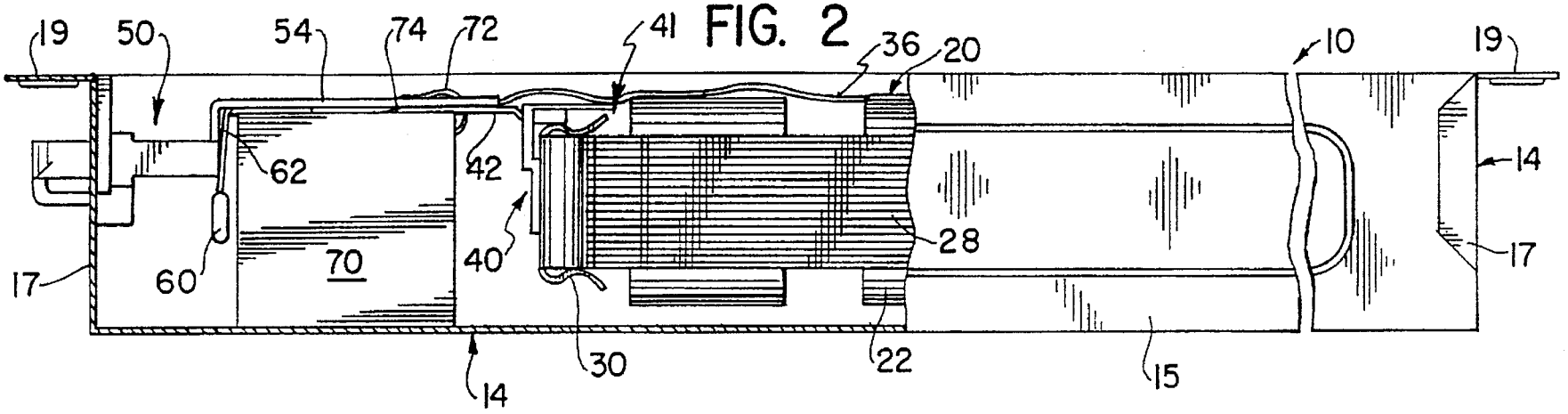
FIG. 2 is an elevational view of the transformer of FIG. 1 having partly broken away.
Figure 3:
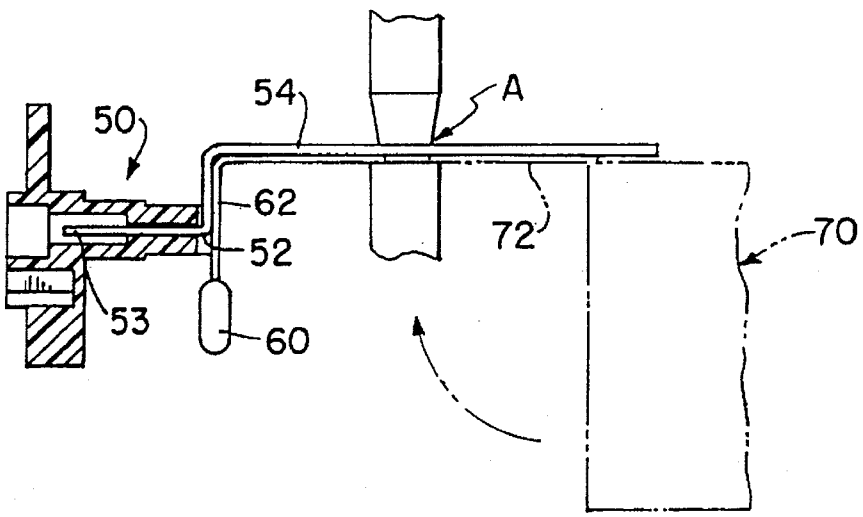
FIG. 3 is a view of a terminal of the connector in cross-section.
Figure 4:
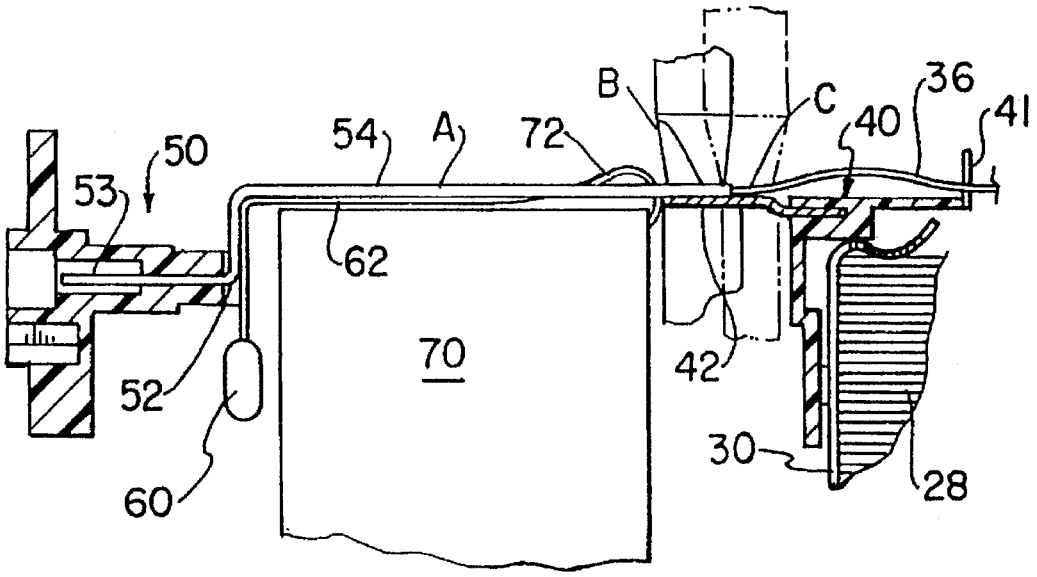
FIG. 4 is an elevational view of the details of the connector and connection wires showing where some of the ultrasonic welding takes place.
Figure 5:
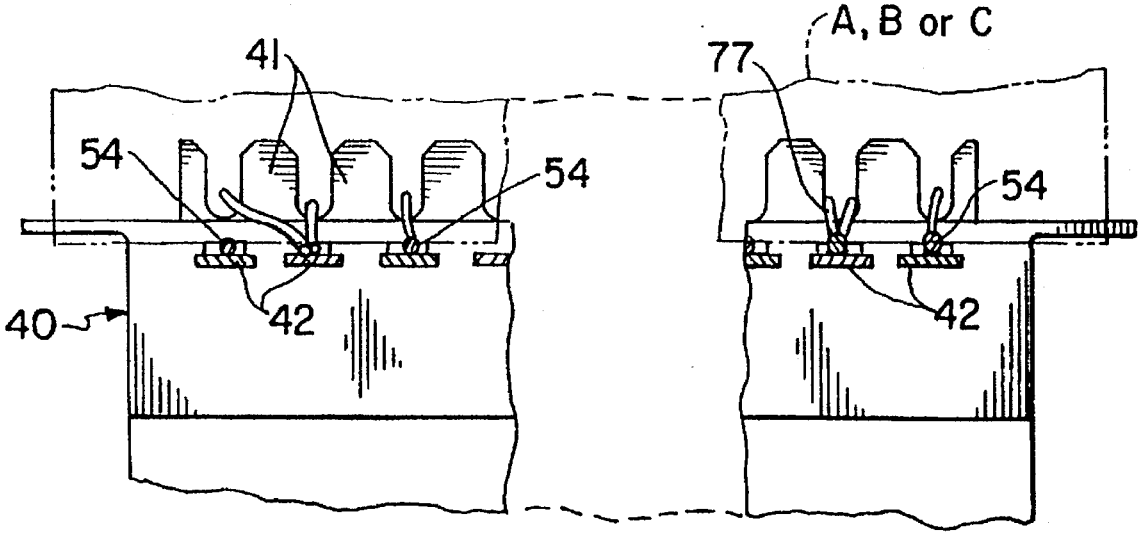
FIG. 5 shows a top view of a part of a terminal board.

Extending from one or more of the connector terminals 52 toward terminal board 40 is a connecting wire 54. Each connecting wire 54 is uninsulated, that is, has no external insulation, such as a sheath of plastic material. Each wire 54 is relatively stiff and is long enough to extend from the connector terminal 52 to over a terminal board lug 42. As seen in FIGS. 2–4, the connection wires 54 have a right angle bend 55 so that the wires extend over the top of capacitor box 70 and are at about the same height as the terminal board lugs, preferably with the wires 54 overlying the tops of the lugs.

As seen in FIGS. 2–4, each of a pair of leads 62 of a smaller capacitor 60 located between the capacitor box 70 and the connector 50 is attached as appropriate to a connection wire 54 extending from the connector 50. Each lead 62 is bent around the top of capacitor box 70 and lies over the insulating paper 74 under the connection wire 54 to which it is to be connected. Here it is ultrasonically welded as a sub-assembly. The leads of other components, such as other capacitors, resistors, and thermal cut-outs, also can be ultrasonically welded to the connection wires 54. A resistor 76 is shown with leads 77 laid over connecting wires 54.

In making a transformer according to the invention, the transformer 20, terminal board 40 and capacitor can 70 are made and assembled to each other outside of the housing. The magnet wire ends 36 are fed between the alignment tabs 41 and laid across appropriate flat terminal board lugs. One end of each of the appropriate number of connection wires 54 is attached to a terminal 52 of connector 50, by ultrasonic welding. The lengths of the connection wires 54 correspond to the distance to the terminal board lugs.

The connector 50 is assembled with the connecting wires 54 extending from all or selected terminal ends 52 depending upon the transformer internal and external wiring configuration. That is, wires 54 may not extend from some of the terminals 52. Each connection wire 54 is generally in-line with the terminal board lug to which a connection is to be made, the terminals and the lugs being selected to effect a predetermined wiring configuration.

The connecting wires 54 are then each laid upon the corresponding, generally in-line terminal board lug. The leads of the external components, such as capacitor 60 and resistor 76 are laid over or under or attached to two of the connector wires 54. As seen in FIGS. 2–4 the leads 62 of capacitor 60 are folded down.

The assembly of the transformer with attached terminal board and the connector wires 54 overlying the terminal board lugs and the leads 62 of the external component is brought under the horn of an ultrasonic welder and the appropriate power is applied so that all of the permanent electrical connections are achieved at the same time.

The ultrasonic welding is preferably done with the assembly outside of the housing. The welding is carried out in several steps designated A, B and C. In step A, the ultrasonic horn welds the leads 62 of capacitor 60 to connecting wires 54; in step C all of the connecting wires 54 are welded to the terminal board lugs; and in step B, which takes place on the terminal board closer to transformer, the ends of the magnet wire coils and the resistor leads 77 are ultrasonically welded to the terminal board lugs.

After the ultrasonic welding is completed, the transformer is placed in the housing and the connector 50 mounted in the end wall. If desired, although somewhat more difficult, the ultrasonic welding can be performed with the transformer and connector already in the housing.

Other modifications of the invention can be made as desired. For example, the terminal board and connector can have several rows of lugs and terminals. Also, if necessary, there can be a connector and terminal board at each end of the housing.

It should be understood that the method and apparatus of the invention has several advantages. These are the combination of the final fastening of all of the leads and wires at one time and the sequential assembly method. This results in the effective utilization of minimal material and lower cost. Automatic assembly methods can be used. These include ultrasonic welding which can weld through the varnish coating of the magnet wires and any other coating, e.g., wax coated wires of the capacitor and lugs. There also is the elimination of stripping of lead wires usually used from the terminal board to the connector and the elimination of standard heat solder materials, etc.

We claim the following:

1. A method of assembling an inductive device within a housing having walls comprising the steps of providing in said housing at least one inductive coil having at least two magnet wire ends;

attaching a terminal board having a plurality of spaced lugs to said at least one inductive coil, engaging each of said magnet wire ends with a corresponding terminal board lug, providing a connector having a plurality of spaced terminals with connecting wires extending from at least some of said connector terminals toward said terminal board, engaging one of said connecting wires with one of said terminal board lugs, a said connecting wire extending directly from between its connector terminal and the corresponding terminal board lug, fixedly electrically connecting each said connecting wire and said magnet wire ends to the corresponding terminal board lugs that they engage, and mounting said connector in a wall of said housing.

2. The method of claim 1 wherein the spacing of the terminal board lugs corresponds to the spacing of the connector terminals.

3. The method of claim 1 wherein the connecting wires are originally uninsulated.

4. The method of claim 3 wherein the step of fixedly connecting comprises a simultaneous connection by ultrasonic welding.

5. The method of claim 3 wherein said connecting wires and said magnet wire ends are ultrasonically welded to said lugs in separate sets.

6. The method of claim 3 further comprising the step of providing a separate component having lead wires, engaging at least one of said lead wires with one of said connecting wires at a position spaced frome one of said terminal board lugs and permanently electrically connecting the lead wires to the connecting wires.

7. The method of claim 3 wherein said connecting wires are stiff and can be bent to have and maintain a predetermined shape.

8. The method of claim 1 wherein said steps of providing said at least one coil within the housing and mounting said connector to said housing take place after the step of fixedly electrically connecting.

9. The method of claim 1 wherein said step of fixedly electrically connecting takes place after said step of providing said at least one coil within said housing and mounting said connector to said housing.

10. The method of claim 1 wherein said connecting wires are stiff and can be bent to have and maintain a predetermined shape.

* * * * *